US007219402B2

(12) United States Patent
Yamazaki

(10) Patent No.: US 7,219,402 B2
(45) Date of Patent: May 22, 2007

(54) SLIDER FOR SLIDE FASTENER

(75) Inventor: Miki Yamazaki, Kurobe (JP)

(73) Assignee: YKK Corporation, Tokyo (JP)

( * ) Notice: Subject to any disclaimer, the term of this patent is extended or adjusted under 35 U.S.C. 154(b) by 56 days.

(21) Appl. No.: 11/013,115

(22) Filed: Dec. 15, 2004

(65) Prior Publication Data

US 2005/0125968 A1 Jun. 16, 2005

(30) Foreign Application Priority Data

Dec. 16, 2003 (JP) ..... 2003-418168

(51) Int. Cl.
*A44B 19/26* (2006.01)

(52) U.S. Cl. ..... 24/429

(58) Field of Classification Search ..... 24/421–425, 24/429–431

See application file for complete search history.

(56) References Cited

U.S. PATENT DOCUMENTS 2,148,757 A * 2/1939 Kilkenny ..... 24/431
2,570,378 A * 10/1951 Rinehart ..... 24/431
2,671,259 A * 3/1954 Rinehart ..... 24/431
4,570,309 A * 2/1986 Ishii ..... 24/429
5,068,950 A * 12/1991 Yuki ..... 24/429
6,026,546 A * 2/2000 Lund et al. ..... 24/431
6,523,232 B2 * 2/2003 Chen ..... 24/431
6,735,827 B1 * 5/2004 Stenhall ..... 24/419

FOREIGN PATENT DOCUMENTS

| | | |
|---|---|---|
| DE | 20119606 | 4/2002 |
| FR | 2248801 | 9/1977 |
| TW | 459489 | 10/2001 |

* cited by examiner

*Primary Examiner*—James R. Brittain
(74) *Attorney, Agent, or Firm*—Everest Intellectual Property Law Group; Michael S. Leonard

(57) ABSTRACT

A slider for a slide fastener comprises: a slide body (1) including an upper wing (15) and a pull tab (2) having a pintle (6); the slider body (1) comprising: a pull-tab-attaching yoke (18) mounted on the upper wing (15) in cantilevered manner, having an indentation (46) formed therein for receiving the pintle (6) directly or indirectly, and defining with the upper wing (15) a gap (47); and a closing member (20) movably mounted on the slider body (1) so as to close and open the gap (47). The pull tab (2) further includes a pull tab body (4) and a pair of opposed protuberant walls (5) provided on the lower side of the pull tab body (4). The pintle (6) extends between the opposed protuberant walls (5) to connect them. At least one of the ends of the opposed protuberant walls (5) is open to provide an open space (7).

5 Claims, 8 Drawing Sheets

SLIDER FOR SLIDE FASTENER

CROSS-REFERENCE TO RELATED APPLICATIONS

The entire disclosure of Japanese Patent Application No. 2003-418168 filed on Dec. 16, 2003 is incorporated herein by reference in its entirety.

BACKGROUND

1. Field of the Invention

This invention relates to a slide fastener to be attached to an opening formed in an article such as clothing or bags, and particularly to a slider for such a slide fastener wherein a decorative-button type pull tab is to be attached to the slider body after the slide fastener has gone or has been shipped from a factory in case that an aesthetic effect must be respected.

2. Description of the Related Art

Heretofore, there has been known a decorative slide fastener slider equipped with a pull tab having a decorative gripping portion. For example, a decorative slider 100 of this type is shown in French Patent No. 2248801 and reproduced in FIG. 10 of the drawings appended hereto for convenience's sake. The decorative slider 100 is comprised of a slider body 102 and a pull tab 104 attached to the slider body 102. The pull tab 104 includes a pull tab base 106 and a declarative plate 108 attached to the upper surface of the pull tab base 106. The pull tab base 106 has a pair of opposed leg portions 110 formed on the lower surface thereof. The opposed leg portions 110 have two engaging portions 112 provided on the respective lower ends so as to project inwards therefrom. The slider body 102 has a pull-tab attaching lug 114 provided on the upper surface thereof. The pull tab base 106 is pressed against the pull-tab attaching lug 114 with their opposed leg portions 110 clamping the lug 114, so that the engaging portions 112 of the pull tab base 106 come into snapping engagement with the attaching lug 114.

There has been known in this field an automatic locking slide fastener slider equipped with a pull tab having a decorative gripping portion. "Automatic locking slider" means a slider having an automatic locking mechanism. One example of an automatic locking type slide fastener slider 200 with a decorative pull tab is shown in German Utility Model Registration No. 20119606 and also reproduced in FIG. 11 of the drawings appended hereto. The automatic locking type slider 200 is assembled as follows: A plate spring 202 and then a locking member 204 is inserted into a cap 206. Then, a rectangular retaining link 208 clamps the thus connected cap 206 and locking member 204 with the upper crossbeam 209 of the rectangular retaining link 208 lying on the upper surface of the cap 206. Then, the cap 206 is mounted to the upper surface of the slider body 210. Then, a grip portion 220 covers the cap 206, with a retaining groove 222 formed in the inner surfaces of the housing portion 224 of the grip portion 220 fit into the upper crossbeam 209 of the rectangular retaining link 208, so that the grip portion 220 is joined with the slider body 210.

In the decorative slider 100 illustrated in FIG. 10, it is a mere snap-engaging mechanism that functions to attach the pull tab base 106 to the slider body 102.

Therefore, if stresses are exerted tending to pull the pull tab base 106 upwardly, the pull tab base 106 is liable to be dislodged from the attaching lug 114 of the slider body 102 very easily. This disadvantageously prevents the user from freely operating the pull tab base 106.

In the decorative slider 200 with an automatic locking mechanism illustrated in FIG. 11, the grip portion 220 and the rectangular retaining link 208 must be formed as separate parts since this is so required by the construction of the slider. This renders the assemblage of the slider 200 as a whole tedious and increases the manufacturing cost. Once the automatic locking type slider 200 has been assembled, it is impossible to replace the grip portion 220 even if the user desires to replace it.

In view of the problems mentioned above, it is an object of the present invention to provide an automatic locking type slider or a locking-mechanism-free slider (hereinafter referred to "free slider"), wherein a pull tab can be attached to the slider body even after the slide fastener has gone or been shipped from a factory, a pull tab body in the form of a decorative button can be attached to a slider body at great ease, and wherein furthermore, if the wearer desires to replace the pull tab body, the pull tab body can be replaced freely.

It is another object of the present invention to provide a slide fastener slider wherein a pull tab body can be installed on the slider body in a well-guided stable manner; and particularly, in case of an automatic locking slider, the pull tab body can be firmly held down on the slider body by a locking member, so that the pull tab can be retained on the slider body in stable manner.

SUMMARY

In accordance with the present invention, there is provided a slider for a slide fastener comprising: a slider body including an upper wing and a pull tab having a pintle; the slider body comprising: a pull tab-attaching yoke mounted in the upper wing in cantilevered manner, having an indentation formed therein for receiving the pintle directly or indirectly, and defining with the upper wing a gap; and a closing member movably mounted on the slider body so as to close and open the gap. The pull tab further includes a pull tab body and a pair of opposed protuberant walls provided on the lower side of the pull tab body. The pintle extends between the opposed protuberant walls to connect them. At lease one of the ends of the opposed protuberant walls is open to provide an open space.

Figure 1:
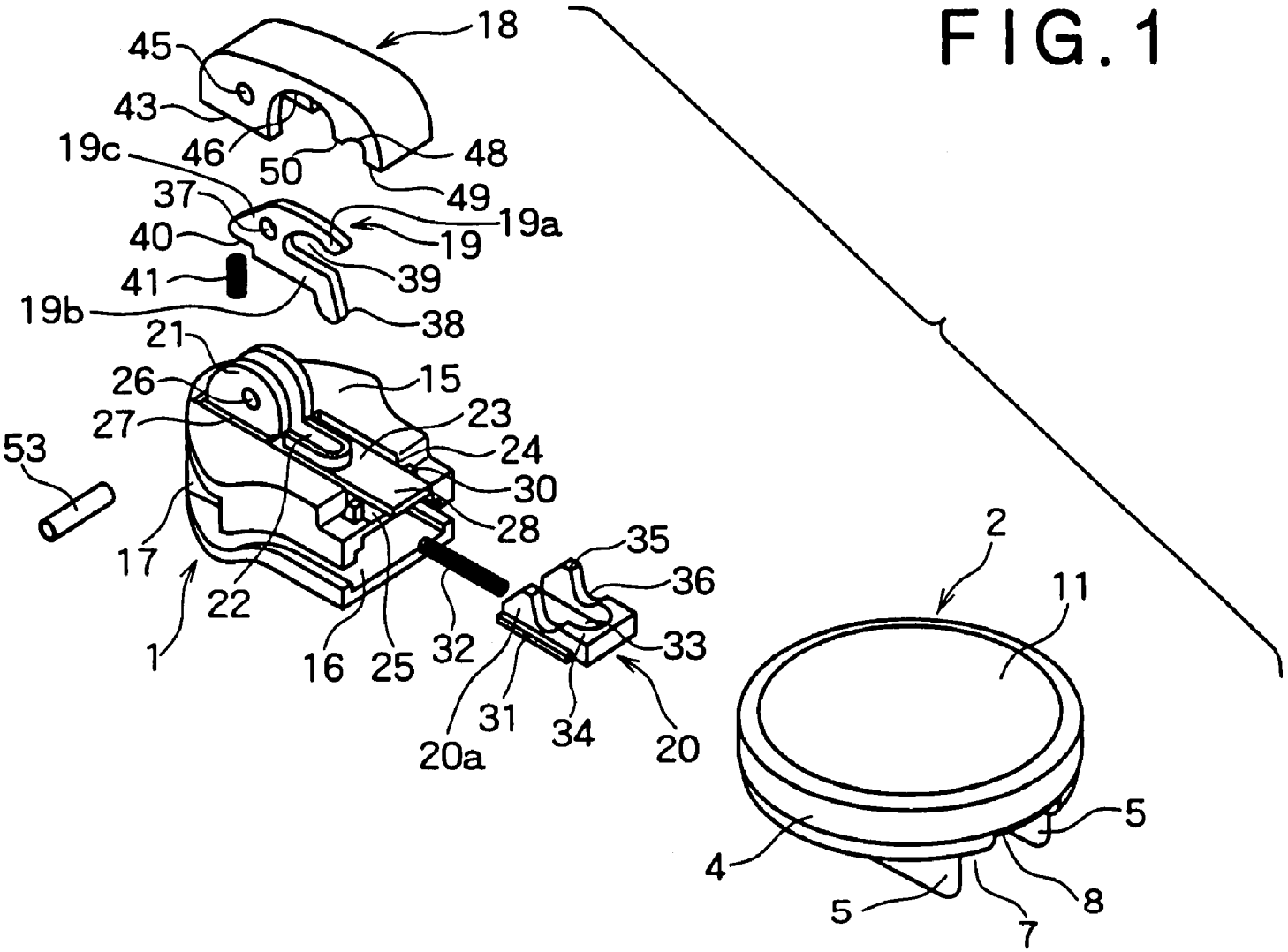
FIG. 1 is an exploded perspective view of an automatic locking slider, according to the first embodiment of this invention, of the type wherein a pull tab is to be attached to the slider body after the slide fastener has been shipped from a factory.

The following provides a list of the reference characters used in the drawings:

1 Slider body
2 Pull tab
4 Pull tab body
5 Protuberant wall
6 Pintle
7 Open space
8 Recess
9 Corner
10 Outer edge portion
15 Upper wing
17 Guidepost
18 Pull-tab-attaching yoke
19 Locking member
20 Closing member
46 Indentation
47 Gap The invention can apply to both automatic-locking slider and free slider of the type wherein a pull tab is to be attached to the slider body after the slide fastener has gone or has been shipped from a factory.

As shown in FIG. 1, a slide fastener slider according to the first embodiment of the present invention is an automatic locking slider of type wherein the slider is of the type wherein a pull tab is to be attached to the slider body after the slider has been shipped from the factory. The slider is comprised of the slider body 1 and a pull tab 2 attached to the slider body 1. The slider body 1 comprises an upper wing 15 and a lower wing 16 joined at their front ends by a guidepost 17, to thus define therebetween the element-guiding channel 55 through which fastener elements (not shown) pass when the slider reciprocate along the fastener element rows. A pair of opposed attaching lugs 21 are mounted on the upper wing 15 above the guidepost 17. A prong hole 22 is formed through the upper wing 15 so as to extend from the proximal end of the attaching lugs 21 towards a rear end 28 of the slider body 1. The prong hole 22 is adapted to freely receive a locking member 19. A sliding channel 23 is formed in the upper wing 15 so as to extend from the prong hole 22 to the rear end 28 and is adapted to slidably receive a closing member 20. The sliding channel 23 is substantially as great in width as a pull-tab-attaching yoke 18. The opposed side walls partly defining the sliding channel 23 have their respective opposed guide grooves 24 formed throughout their length. The closing member 20 has ridges 31 formed on the opposite sides thereof as closely described hereinbelow. The opposed ridges 31 of the closing member 30 are adapted for sliding engagement with the opposed guide grooves 24 of the sliding channel 23. A spring groove 25 is formed alongside one of the guide grooves 24 (left one as viewed in FIG. 1 here). A coiled spring 32 is inserted into the spring groove 25 and has its one end abutted against the closing member 20 so as to normally urge the closing member 20 rearwardly or in the direction to close a gap 47 mentioned hereinbelow.

The opposed attaching lugs 21 have a pair of aligned pin holes 26 formed therethrough to let a pin 53 pass therethrough. The pin 53 is inserted through a pin hole 37 formed though the locking member 19 and pin holes 45 formed through the pull-tab-attaching yoke 18. A pair of attaching grooves 27 are formed in the upper wing 15 alongside the outer sides of the opposed attaching lugs 21. The proximal end 43 of the pull-tab-attaching yoke 18 firmly fits into the attaching groove 27 of the upper wing 15 so that the pull-tab-attaching yoke 18 can be fixed to the slider body 1. A small projection 30 is provided beside the rear end 28 of the sliding channel 23. After the closing member 20 is inserted into the sliding channel 23, the small projection 30 is turned over or clinched against the sliding channel 23 to thereby retain the closing member 20 in the sliding channel 23 against dislodgment therefrom.

The locking member 19 is in the shape of substantially V-shaped plate and bifurcated to provide a pair of upper and lower leg portions 19*a*, 19*b* joined by the vertical portion 19*c*. A lower leg 19*b* is bent downwardly to provide a locking prong 38. A pin hole 37 is formed through the vertical portion 19*c* of the locking member 19. The V-shaped locking member 19 has a recess 39 defined between the upper and lower leg portions 19*a* and 19*b* for receiving the pintle 6 of the pull tab 2. The locking member 19 further has an abutting portion 40 provided below the vertical portion 19*c*. A spring 41 is arranged between the abutting portion 40 of the locking member 19 and the slider body 1 and normally urges the abutting portion 40 upwardly and hence the locking prong 38 downwardly to thus cause the locking prong 38 project into the element-guide channel 55, thereby locking the slider to the element rows.

The closing member 20 is substantially U-shaped as viewed from above in FIG. 1 and comprises a pair of side arms 20*a* and a raised closing crossbar 34 joining the side arms at their rear ends to thus provide an opening 33 therebetween. The opening 33 functions to prevent the closing member 20 from interfering the operation of the locking member 19. A pair of opposed projections 35 are provided on the front or distal ends of the side arms 20*a* of the closing member 20 and adapted to prevent a pintle 6 of a pull tab 2 from passing therebeyond and being dislodged from the slider body 1, in cooperation with the projections 50 of the pull-tab-attaching yoke 18. Furthermore, the side arms 20*a* of the locking member 20 are recessed in their upper parts in the middle to provide notches 36 so as to tentatively receive the pintle 6. A pair of guide ridges 31 are provided on the outer sides of the side arms 20*a* of the closing members 20 and adapted to fit into the guide grooves 24 formed in the side walls of the sliding channel 23.

The pull-tab-attaching yoke 18 is like a hood having a hollow 44 formed inside; as viewed in profile, is substantially C-shaped; and has its proximal end portion bent downwards. The proximal end portion 43 of the yoke 18 is put onto the attaching lugs 21 of the slider body 1 with its lower rim fit into the attaching groove 27 of the slider body 1, so that the yoke 18 is mounted on the slider body 1 in cantilevered manner. The yoke 18 extends along the length of the slider body 1 and the distal end 49 of the yoke 18 is bent downwardly and terminates short of the rear end 28 of the slider body 1, thereby defining the gap 47 with the rear end 28 of the slider body 1. The yoke 18 has a pair of opposed arcuate indentations 46 formed in the lower side thereof and adapted to receive the pintle 6 of the pull tab 2. A pair of shunting recesses 48 are also formed in the yoke 18 between the indentations 46 and the distal end 49 for tentatively receiving the pintle 6 of the pull tab 2. Furthermore, the yoke 18 has a pair of projections 50 formed between the indentations 46 and the corresponding shunting recesses 48 to thus prevent the pintle 6 of the pull tab 2 from dislodgment, in cooperation of the projections 35 of the closing member 20. Instead of being C-shaped, the pull-tab-attaching yoke 18 may be of any other suitable shape.

Figure 5:
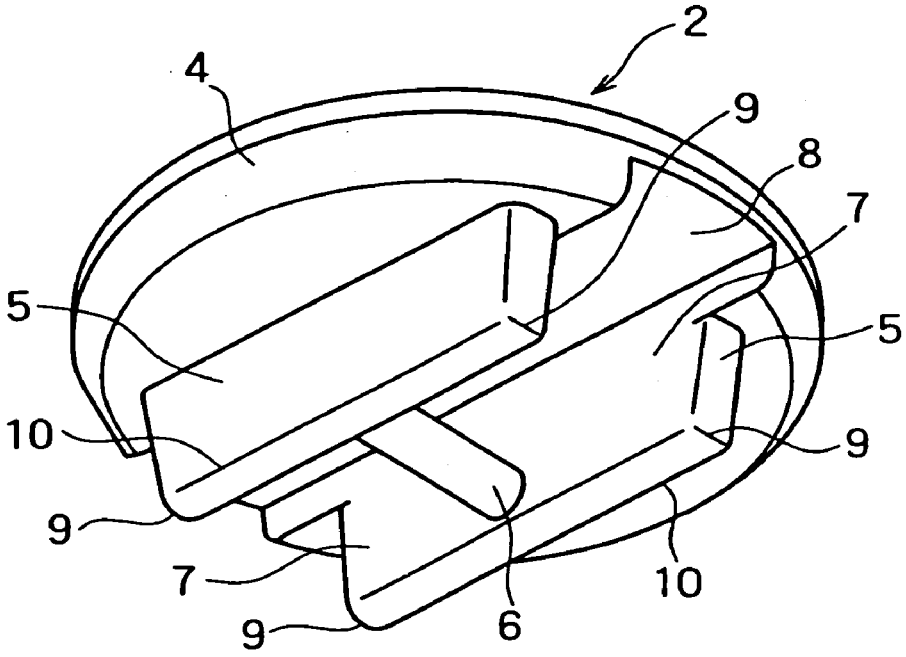
FIG. 5 is a perspective view showing the lower side of a pull tab.

As shown in FIG. 5, the pull tab 2 includes a disk-like pull tab body 4 and a pair of rectangular protuberant walls 5 mounted on the lower side thereof and disposed in spaced parallel relation with each other. The pintle 6 is mounted between the protuberant walls 5 at their middle to connect them. When the pull tab 2 is attached to the slider body 1, the pintle 6 of the pull tab 2 is adapted to pass through the gap 47 formed between yoke 18 and the rear end 28 of the slider body 1 and to be inserted into the recess 39 of the locking member 19. A recess 8 is formed in the lower side of the pull tab 2 between the parallel protuberant walls 5 and is adapted to loosely receive the upper part of the yoke 18. Since the depth of the recess 8 formed in the pull tab body 4 can be compensated by decreasing height of the protuberant walls 5, the pull tab body 2 as a whole can be made advantageously compact. A pair of open spaces 7 are provided one at each of the front and rear ends of the protuberant walls 5 to thus facilitate installation of the pull tab body 4 on the yoke 18. After the pull tab 2 has been mounted on the slider body 1, the corners 9 of both ends of the protuberant walls 5 function as a fulcrum on which the pull tab 2 pivots longitudinally of the slider body 1. Furthermore, the outer edges of the opposed protuberant walls 5 also function as a fulcrum on which the pull tab 2 pivots laterally of the slider body 1. The pull tab body 4, the protuberant walls 5 and pintle 6 are integrally formed through die-casting process from metals such as zinc alloy, aluminum alloy. Therefore, the pull tab 2 can be made stout and the pull tab 2 can be attached to the slider body 1 at ease. Each protuberant wall 5 of the pull tab 2 is substantially as great in length as the side of the pull-tab-attaching yoke 18.

Figure 6:
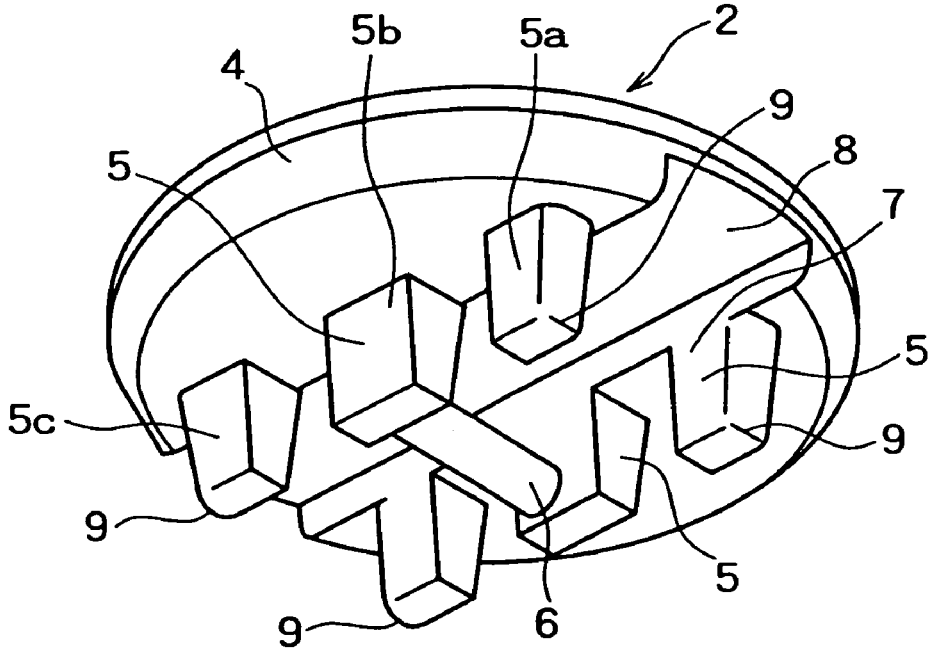
FIG. 6 is a perspective view showing the lower side of a modification of the pull tab.
Figure 9:
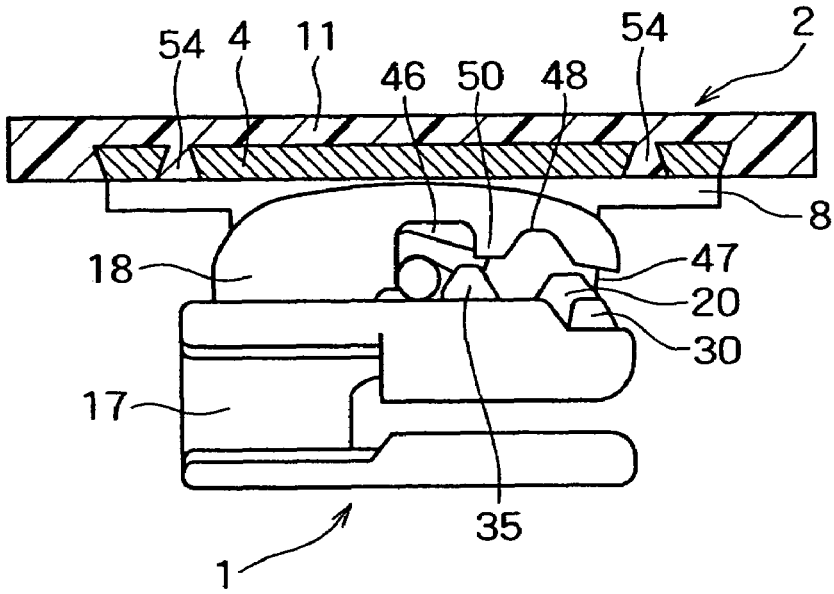
FIG. 9 is a partly cross-sectional side view showing an automatic locking slider equipped with a decorative pull tab.
Figure 10:
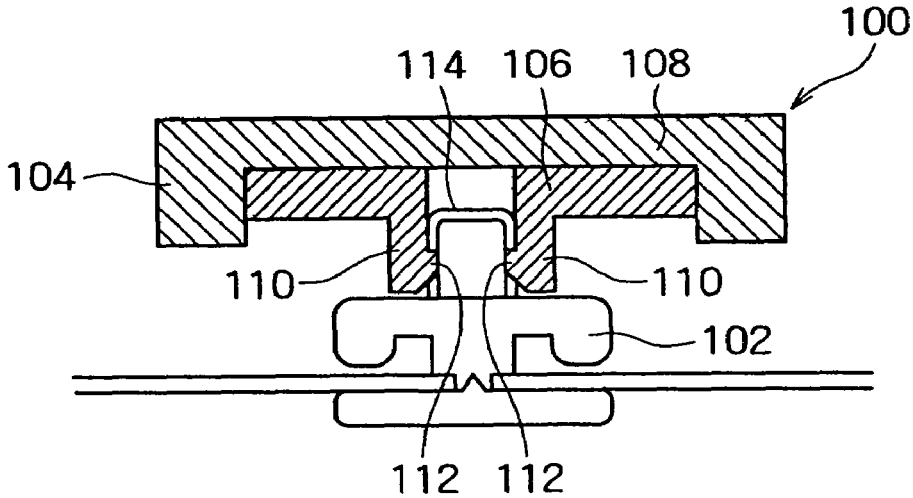
FIG. 10 PRIOR ART
FIG. 10 is a cross-sectional view of a conventional free slider equipped with a decorative pull tab.
Figure 11:
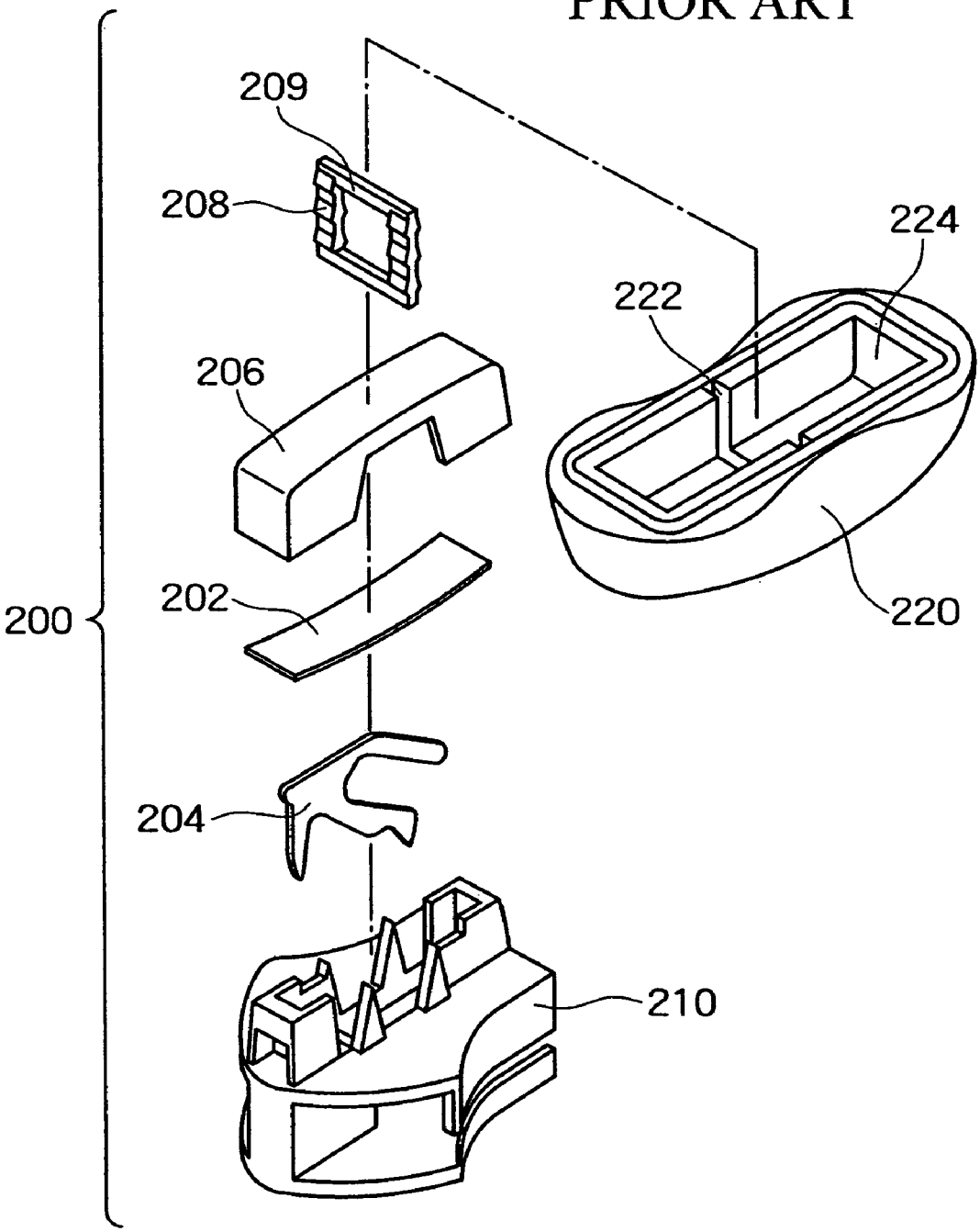
FIG. 11 PRIOR ART
FIG. 11 is an exploded perspective view of a conventional automatic locking slider equipped with a decorative pull tab.

The shape of the pull tab body 4 and the shape and pattern of a decorative portion of the pull tab 2 can be selected optionally. For example, as shown in FIG. 9, dovetail grooves or truncated conical through holes 54 with its larger-diamtered opening in the lower side of the pull tab body 4 may be formed through the pull tab body 4. The decorative portion 11 is molded from soft or hard plastics upon the upper surface of the pull tab body 4, to thus provide the decorative pull tab 2. A pull tab 2 shown in FIG. 6 is a modification of the pull tab 2 shown in FIG. 5. Instead of two continuous protuberant walls 5, in this modified pull tab 2, two parallel rows of interrupted walls 5 (three on each row here) are mounted on the lower side of the pull tab body 4. A pintle 6 is mounted between the opposed middle walls 5*b* to connect them. The terminal walls 5*a*, 5*c* on each row are intended to prevent the pull tab 2 from excessively pivoting on the slider body 1.

In order to assemble the slider body 1, as shown in FIG. 1, first, the coil spring 32 is inserted into the spring groove 25 and the closing member 20 are inserted into the sliding channel 23 of the slider body 1 with the coil spring 32 interposed between the closing member 20 and the slider body 1, and the closing member 20 is forced forwardly. After the closing member 20 advance beyond the small projections 30 provided on the opposite sides of the inlet of the sliding channel 23, the small projections 30 are turned over and clinched against the sliding channel 23, to thus retain the closing member 20 in the sliding channel 23 of the slider body 1 against dislodgment therefrom. Then, the locking member 19 is inserted between the attaching lugs 21. Then, the coil spring 41 is arranged between the abutting portion 40 of the locking member 19 and the slider body 1. Then, the yoke 18 is placed over the locking member 19 with the proximal end portion 43 of the yoke 18 fitted into the attaching groove 27, so that the locking member 19 is housed in the yoke 18. Then, the pin holes 26 of the attaching lugs 21, the pin hole 37 of the locking member 19 and the pin holes 45 of the yoke 18 are brought into registry with each other, and thereafter the pin 53 is inserted into the pin holes 26 of the attaching lugs 21, the pin hole 37 of the locking member 19 and the pin holes 45 of the yoke 18. Then, the pin 53 is clinched to the yoke 18 so that the slider body 1 is assembled.

Figure 2:
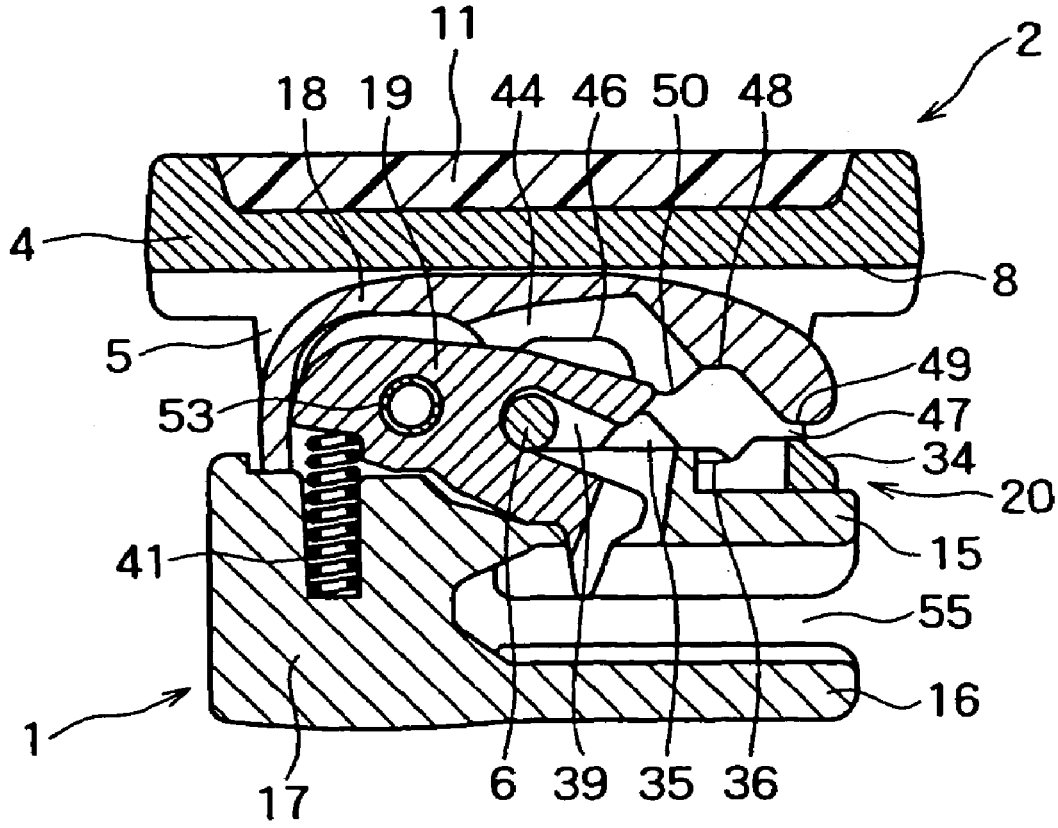
FIG. 2 is a cross-sectional view of the slider of FIG. 1.

In order to attach the pull tab 2 to the thus assembled slider body 1, as shown in FIG. 2, the pair of protuberant walls 5 of the pull tab body 4 are slid on the upper wing 15 of the slider body 1 forwardly from the gap 47, with the recess 8 of the pull tab body 4 in alignment with the attaching yoke 18 of the slider body 1. As a result, the pintle 6 of the pull tab body 4 comes into contact with the closing crossbar 34 of the closing member 20. The closing member 20 is moved forwards against the bias of the coil spring 32 by simply pushing the closing member 20 by the pintle 6 of the pull tab 2.

The closing member 20 is moved forwards until the pintle 6 is tentatively received within the notches 36 of the closing member 20. Continued thrust of the pintle 6 forwardly brings the closing member 20 to a stop and cause the pintle 6 climb up along the opposed projections 35 of the closing member 20. As soon as the pintle 6 received in the notches 36 of the closing member 20 climbs over the opposed projections 35, the pintle 6 pushes up the upper leg portion 19*a* of the locking member 19 and comes into the recess 39 of the locking member 19, so that the pintle 6 of the pull tab 2 is received in the indentations 46 of the yoke 18; in other words, the indentations 46 of the yoke 18 receive the pintle 6 of the pull tab 2 indirectly through the locking member 19. The closing member 20 restores into the original position through the bias of the coil spring 32. The spring 41 urges the recess 39 of the locking member 19 downwards and thus urges the pintle 6 received in the recess 39 against the upper wing 15 of the slider body 1, so that the protuberant walls 5 are pressed against the upper wing 15. Since the protuberant walls 5 of the pull tab body 4 are pressed against the upper wing 15, the pull tab body 4 will not swing excessively on the slider body 1.

Figure 7:
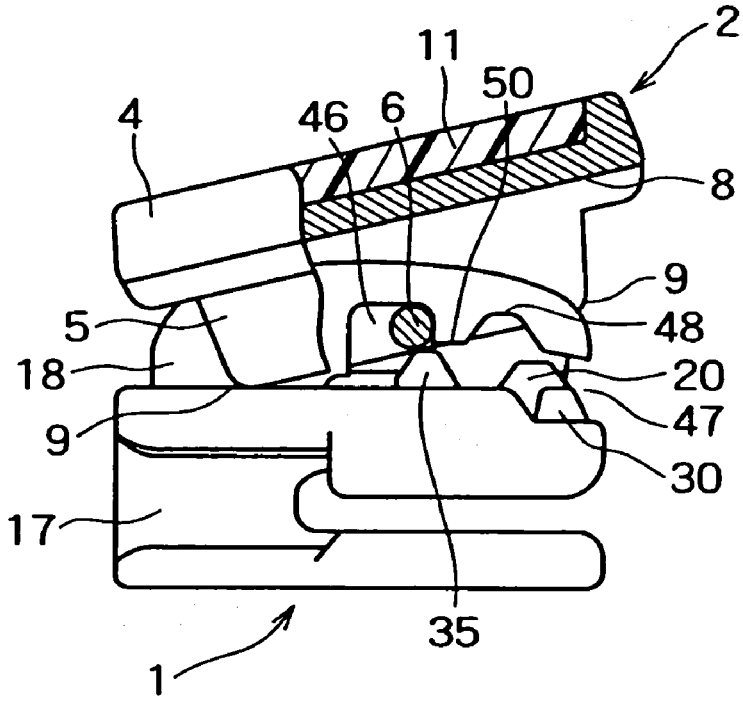
FIG. 7 is a partly cross-sectional side view showing the automatic locking slider when the rear end of the pull tab is lifted.
Figure 8:
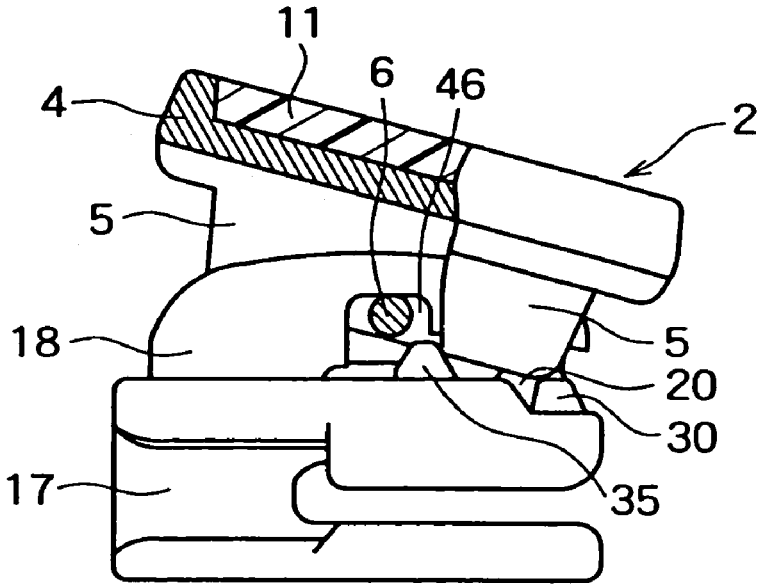
FIG. 8 is a partly cross-sectional side view showing the automatic locking slider when the front end of the pull tab is lifted.

The method of operating the pull tab 2 thus attached to the slider body 1 is shown in FIGS. 7 and 8. Either the front end or the rear end of the pull tab body 4 are gripped and the pull tab body 4 is pulled up and to thus raise the locking member 19 disposed within the yoke 18 and bring the locking prong 38 of the locking member 19 out of locking engagement with the fastener elements, so that the slider can move reciprocally along the fastener elements. If the user desires to replace the pull tab 2, the closing member 20 is thrust forwards with a pointed device. Then, the rear end of the pull tab body 4 is raised and the pintle 6 of the pull tab body 4 is moved into the notches 36 of the closing member 20. Then, the closing member 20 is restored into the original position. Then, the pintle 6 of the pull tab body 4 is moved into the shunting recess 48 of the yoke 18. Then, the closing member 20 is moved forwards beyond the pintle received in the shunting recess 48, with the rear end of the pull tab body 4 raised, so that the pintle 6 can be released from the slider body 1 through the gap 47 and then the pull tab can be replaced.

Figure 3:
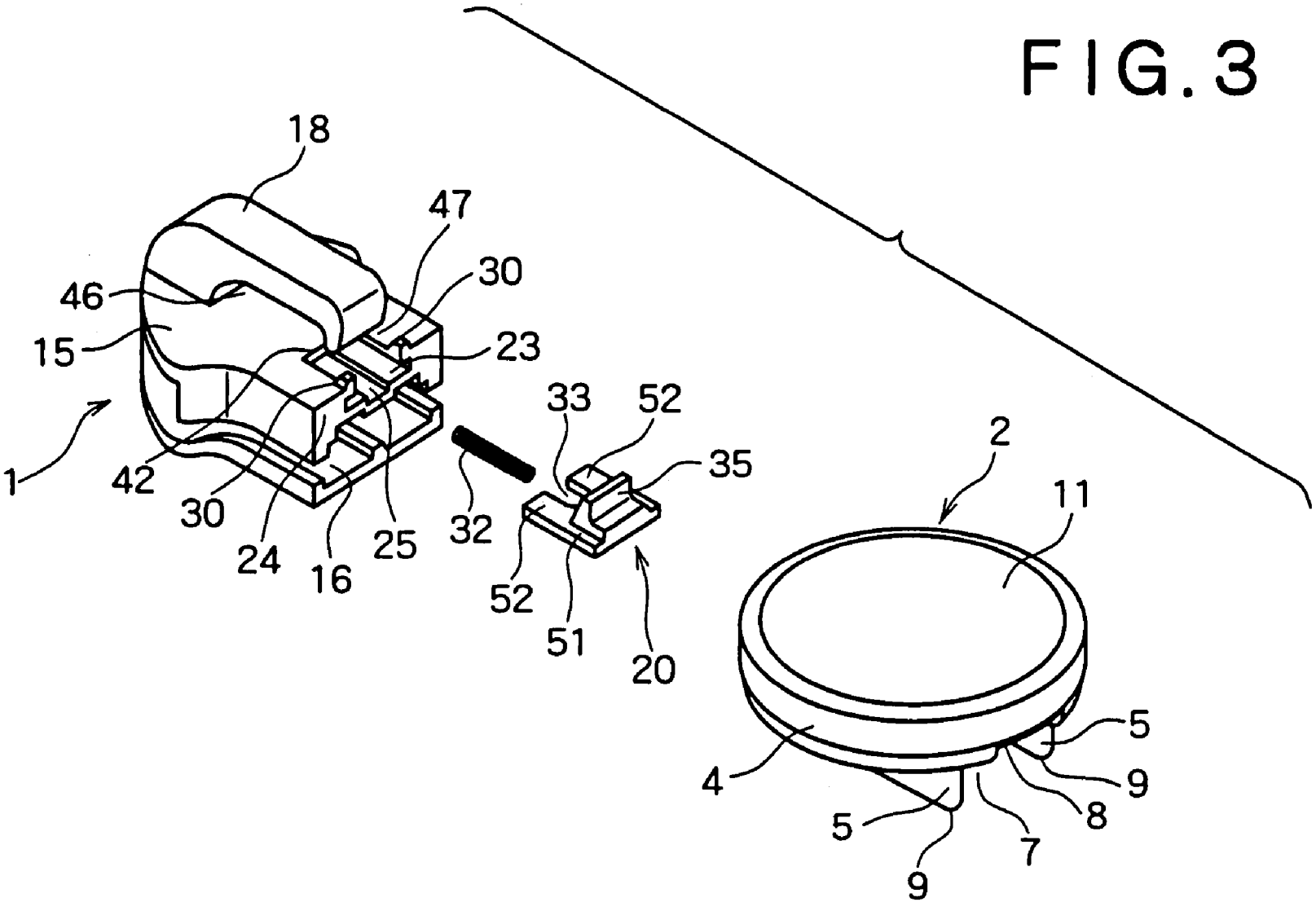
FIG. 3 is an exploded perspective view of a free slider, according to the second embodiment of this invention, of the type wherein a pull tab is to be attached to the slider body after the slide fastener has been shipped from a factory

A slide fastener slider according to the second embodiment of the present invention shown in FIG. 3 is so-called a free slider, and further the slider is of the type wherein a pull tab is to be attached to the slider body after the slider has been shipped from the factory. The slider body 1 is comprised of an upper wing 15 and a lower wing 16 joined at their front ends by a guidepost 17. As viewed in profile, a pull-tab-attaching yoke 18 is substantially C shaped and has its proximal end mounted on the upper surface of the upper wing 15 above the guidepost 17 in cantilevered manner. The distal end of the yoke 18 is bent downwardly towards the upper wing 15 and terminates short of the upper wing 15, thereby defining with the upper wing 15, a gap 47 through which the pintle 6 of the pull tab body 4 can pass. The upper wing 15 has a sliding channel 23 formed in its upper surface in such a way to extend from below the pull-tab-attaching yoke 18 to the rear end of the upper wing 15. Along the sliding channel 23, a closing member 20 is adapted to be reciprocally mounted in order to close the space 47. The opposed inner side walls partly defining the sliding channel 23 have their respective opposed guide grooves 24 formed throughout their length in order to guide the closing member 20. A spring groove 25 is formed centrally along the sliding channel 23 to receive a coil spring 32 therein. An insertion cavity 29 is formed as an extension of the sliding channel 23 within the upper wing 15, and communicates with the sliding channel 23 and the spring groove 25 in order to receive both side arms 52 of the closing member 20. The hind end of the insertion cavity 29 constitutes a stop portion 42 to check the advance of the closing member 20. A pair of small projections 30 are provided on the opposite sides of the sliding channel 23 adjacent to the rear end of the slider body 1. After the closing member 20 is reciprocally mounted in the sliding channel 23, the small projections 30 are clinched against the sliding channel 23 to thus prevent the closing member 20 from being dislodged from the sliding channel 23.

The closing member 20 is in the shape of a U-shaped flat base plate 51 and has its front end bifurcated to provide a pair of opposed side arms 52. A spring 32 is disposed longitudinally in the opening 33 defined between the side arms 52 of the closing member 20. Then, the spring 32 is inserted through the spring groove 25 of the sliding channel 23 and into the insertion cavity 29 formed transversely of the upper wing 15, to thus normally urge the closing member 20 rearwardly. A projection 35 is mounted on the upper surface of the base plate 51 of the closing member 20 to close the gap 47 between the distal end 49 of the yoke 18 and the upper wing 15.

A pull tab 2 of the same shape as the one according to the first embodiment can be used in the second embodiment as well. If possible, the protuberant walls 5 should be formed shorter, so that, when the pull tab 2 is swung, the corners 9 of the protuberant walls 5 can contact the upper surface of the upper wing 15. Alternatively, the receiving indentations 46 of the yoke 18 adapted for receiving the pull tab 2 should be made compact so that the corners 9 of the protuberant walls 5 can not contact the slide fastener chain.

In order to assemble this slider, as shown in FIG. 3, the spring 32 is inserted through the spring groove 25 of the sliding channel 23 into the insertion cavity 29. Then, the base plate 51 of the closing member 20 is inserted into the sliding channel 23 and advanced therealong until the opposed side arms 52 of the closing member 20 hold the spring 32 therebetween. After the closing member 20 advance beyond the small projections 30 provided on the opposite sides of the sliding channel 23, the small projections 30 are clinched against the sliding channel 23 to thus prevent the closing member 20 from being dislodged from the sliding channel 23.

Figure 4:
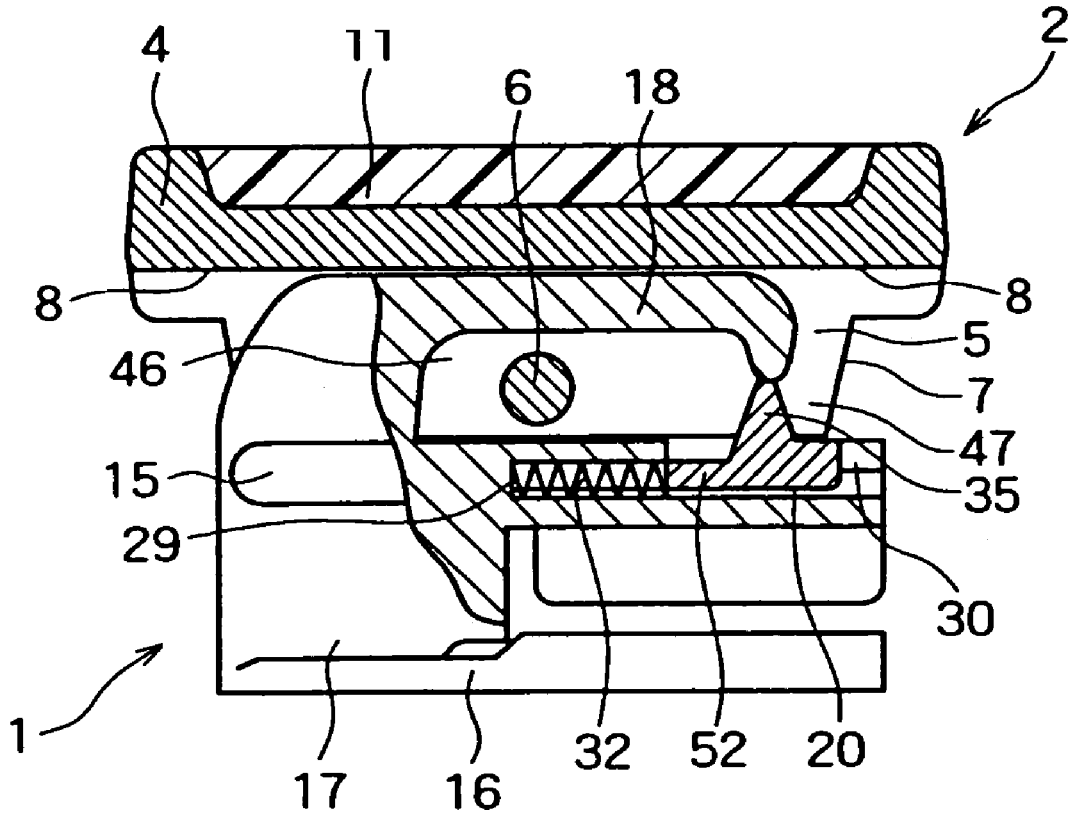
FIG. 4 is a cross-sectional view of the slider of FIG. 3.

In order to attach the pull tab 2 on the thus assembled slider body 1, as shown in FIG. 4, the pair of protuberant walls 5 of the pull tab body 4 is slid on the upper wing 15 from the gap 47 forwardly, with recess 8 of the pull tab body 4 in alignment with the pull-tab-attaching yoke 18, so that the pintle 6 of the pull tab 2 contacts and thrusts the closing member 20 forwards. The pintle 6 further advances, pushing the closing member 20 against the bias of the spring 32, so that the pintle 6 comes into the indentation 46 of the yoke 18 and the indentation 46 of the yoke 18 directly receives the pintle 6 of the pull tab 2. The pull tab 2 is now attached to the slider body 1. The pull tab 2 according to the second embodiment is same in the method of operation as the one according to the first embodiment. But, since the indentation 46 of the yoke 18 is greater in length, the pull tab 2 moves over greater distance to and fro, so that the intermediate parts of the protuberant walls 5 contact the end of the slider body 1 and the corners 9 of the protuberant walls 5 tend to contact the fastener chain. In order to prevent the corners 9 of the protuberant walls 5 from contacting the fastener chain, as mentioned earlier, the protuberant walls 5 should be formed shorter. Alternatively, the corners 9 of the protuberant walls 5 may be firmed arcuate or chamfered Still alternatively, the indentations 46 of the yoke 18 may be formed shorter in order to shorten the distance of the to-and-fro movement of the pintle 6 of the pull tab 2. In order to replace the pull tab, the closing member 20 is thrust deeply into the indentation 46 of the yoke 18 by a pointed tool to thus open the gap 47. Then, the pintle 6 of the pull tab 2 is released from the indentation 46 of the yoke 18 through the gap 47, so that the pull tab 2 can be replaced.

The pull tab 2 according to the present invention can be readily applied to various sliders of the type wherein a pull tab is to be attached to the slider body after the slide fastener has been shipped from a factory. For example, it may be also applied to a free slider of the above-mentioned type (although not shown in the drawings) wherein the proximal end of a C-shaped pull-tab-attaching yoke may be mounted on the upper wing at the rear end of the slider body in cantilevered manner and the distal end thereof extends forwardly, unlike the slider body of the preceding embodiments. In this slider, a closing member and a coil spring are mounted one upon the other in a vertical groove formed in a guidepost provided on the front end of the slider body. The closing member is normally urged by the coil spring underlining it upwardly to thus close a gap defined between the distal end of the yoke and the slider body. A pull tab body is inserted from the guidepost end into a indentation of the pull-tab-attaching yoke of the slider body.

CONCLUSION, RAMIFICATIONS, AND SCOPE

Accordingly, a pull tab can be attached to a slider body at very ease and various decorative patterns can be applied to an upper surface of a pull tab body at ease, so that aesthetically attractive sliders can be produced, and the pull tabs can be replaced easily even while the slide fastener is in use.

Furthermore, the pull tab can be inserted into and attached to the pull-tab-attaching yoke of both types of sliders, that is, an automatic locking slider and free slider in stable manner. Particularly for an automatic locking slider, the spring-loaded locking member can urge the pull tab body against the slider body in stable manner, so that the pull tab body is held stably on the slider body.

Furthermore, the pull tab body can be pivot both to and fro, and rightwards and leftwards, so that the pull tab can be pulled in smooth manner.

The slide fastener slider according to this invention is used to close the opening formed in such clothing and bags wherein importance is attached to decoration. The slider has a pull tab with aesthetic designs which looks like an ornamental button. The slider is now equipped with a mechanism whereby the decorative fancy pull tabs can be attached and replaced freely while in use in clothing and bags.

Although the description above contains many specificities, these should not be construed as limiting the scope of the invention but as merely providing illustrations of some of the presently preferred embodiments of this invention. Many other variations are possible.

Thus, the scope of the invention should be determined by the appended claims and their legal equivalents, rather than by the examples given.

What is claimed is:

1. A slider for a slide fastener comprising: a slider body including an upper wing and a pull tab having a pintle; the slider body comprising:

a pull-tab-attaching yoke mounted on the upper wing in cantilevered manner, having an indentation formed therein for receiving the pintle, and defining with the upper wing a gap; and a closing member movably mounted on the slider body so as to close and open the gap;

the pull tab further including a pull tab body and a pair of opposed protuberant walls provided on the lower side of the pull tab body, the pintle extending between the opposed protuberant walls to connect them; at least one of the ends of the opposed protuberant walls being open to provide an open space;

wherein the pull tab body pivotally receives the pull-tab-attaching yoke of the slider body between the opposed protuberant walls;

wherein when the pull tab is attached to the slider body, the pair of protuberant walls of the pull tab body is slid on the upper wing; and wherein each one of the pair of opposed protuberant walls has opposed longitudinal corners which contact an upper side of the slider body and are fulcrums on which the pull tab pivots longitudinally on the upper side of the slider body.

2. A slider for a slide fastener recited in claim 1, wherein each protuberant wall of the pull tab body is substantially as great in length as the side of the pull-tab-attaching yoke.

3. A slider for a slide fastener recited in claim 1, wherein the pull tab body is pivotable on the outer side edges of the protuberant walls, laterally of the protuberant walls.

4. A slider for a slide fastener recited in claim 1, wherein the pull tab body has a recess formed on the lower side thereof between the opposed protuberant walls.

5. A slider for a slide fastener recited in claim 1, wherein the pull tab body, protuberant walls and pintles are integrally formed through a molding process to thus provide the pull tab as one piece.

* * * * *